US008052304B2

(12) United States Patent
Yang et al.

(10) Patent No.: US 8,052,304 B2
(45) Date of Patent: Nov. 8, 2011

(54) LED LAMP ASSEMBLY

(75) Inventors: Ri-Lang Yang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 221 days.

(21) Appl. No.: 12/475,528

(22) Filed: May 31, 2009

(65) Prior Publication Data

US 2010/0220480 A1 Sep. 2, 2010

(30) Foreign Application Priority Data

Mar. 2, 2009 (CN) ..... 2009 1 0300645

(51) Int. Cl.
*F21V 21/00* (2006.01)
*F21S 4/00* (2006.01)

(52) U.S. Cl. ..... 362/249.06; 362/249.02; 362/294; 362/373; 362/800

(58) Field of Classification Search ..... 362/249.02, 362/249.06, 249.14, 249.16, 249.19, 294, 362/373, 800, 240, 545, 640–659
See application file for complete search history.

(56) References Cited

U.S. PATENT DOCUMENTS 7,458,706 B1 * 12/2008 Liu et al. ..... 362/373
7,607,802 B2 * 10/2009 Kang et al. ..... 362/294
7,631,988 B2 * 12/2009 Xie et al. ..... 362/294
7,794,110 B2 * 9/2010 Hirni et al. ..... 362/241

* cited by examiner

*Primary Examiner* — Ismael Negron
*Assistant Examiner* — Tsion Tumebo
(74) *Attorney, Agent, or Firm* — Altis Law Group, Inc.

(57) ABSTRACT

An LED lamp assembly includes a fixing holder adapted for positioning the LED lamp assembly at a desired position and a plurality of LED lamp modules superposed one by one on the fixing holder and spaced from each other. The LED lamp modules gradually increase in dimension along a superposing direction of the LED lamp modules. Each of the LED lamp modules includes a heat sink and an LED module attached to the heat sink. The heat sinks of the LED lamp modules gradually increase in dimension along the superposing direction of the LED lamp modules. The LED lamp modules are connected by a rod between the heat sinks of adjacent ones of the LED lamp modules.

18 Claims, 4 Drawing Sheets

LED LAMP ASSEMBLY

BACKGROUND

1. Technical Field

The disclosure relates to LED (light emitting diode) lamp assemblies for illumination purpose and, more particularly, relates to an improved LED lamp assembly having a good heat dissipation capability and large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages; the LED lamps often act as street, lawn or home lamps for illumination purpose. Known implementations of LED modules in an LED lamp make use of a plurality of individual LEDs to generate light that is ample and of satisfactory spatial distribution. The large number of LEDs, however, increases price and power consumption of the module. Considerable heat is also generated, which, if not adequately addressed at additional expense, impacts LED lamp reliability.

Further, since the LEDs are generally arranged on a printed circuit board having a flattened surface, illumination is distributed at a wide variety of spatial angles with sharp differences in intensity and brightness, making it unsuitable for environments requiring even and broad illumination. Finally, the LEDs mounted on the flattened surface of the printed circuit board cannot have a large area of illumination.

What is needed, therefore, is an improved LED lamp assembly which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
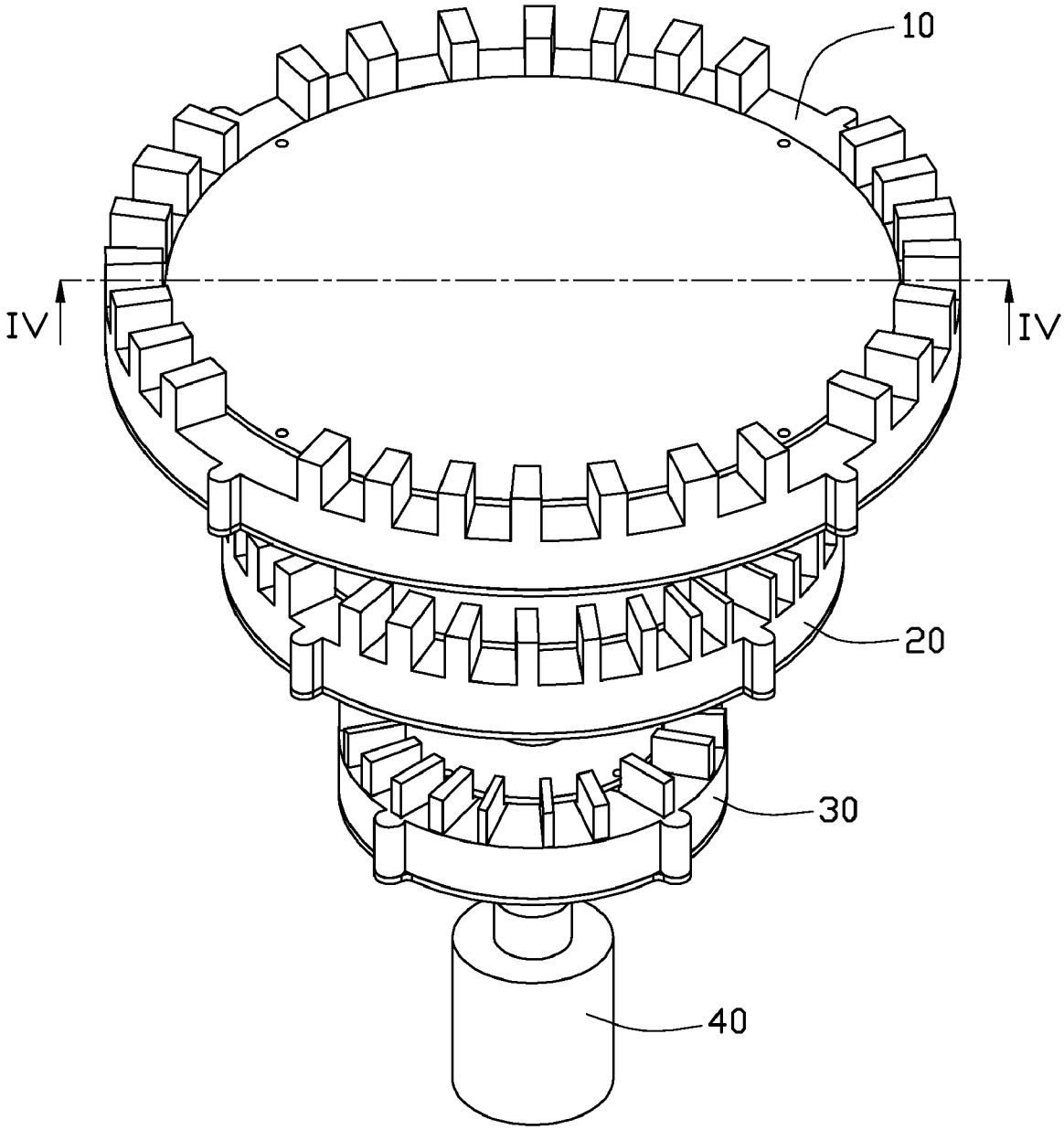
FIG. 1 is an isometric, assembled view of an LED lamp assembly in accordance with an embodiment of the disclosure.
Figure 2:
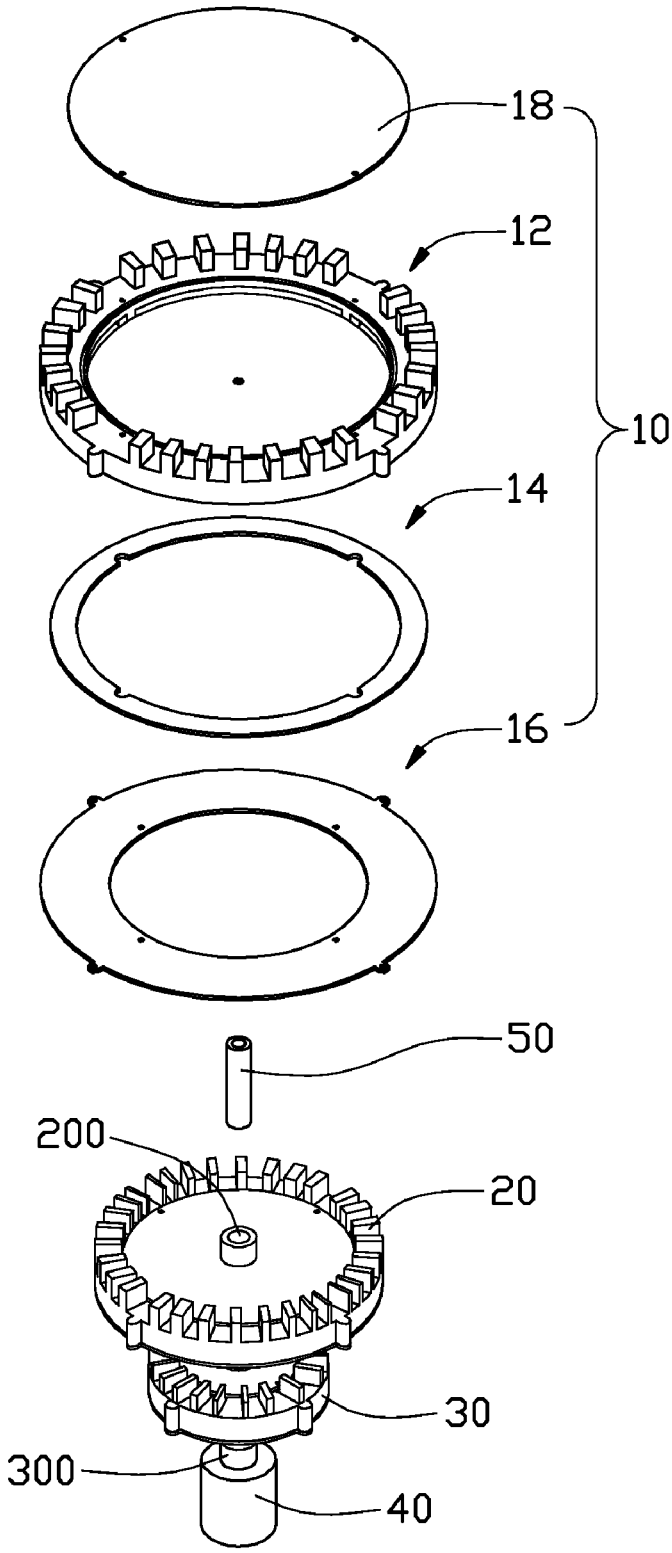
FIG. 2 is an exploded view of the LED lamp assembly of FIG. 1.

Referring to FIGS. 1-2, an LED lamp assembly in accordance with an embodiment of the disclosure is illustrated. The LED lamp assembly comprises a fixing holder 40 adapted for positioning the LED lamp assembly at a desired position, a third LED lamp module 30 securely disposed on the fixing holder 40, a second LED lamp module 20 superposing on the third lamp module 30 and a first LED lamp module 10 superposing on the second LED lamp module 20. The LED lamp assembly further comprises fixing rods 50 supporting the first, second and third LED lamp modules 10, 20, 30.

Figure 3:
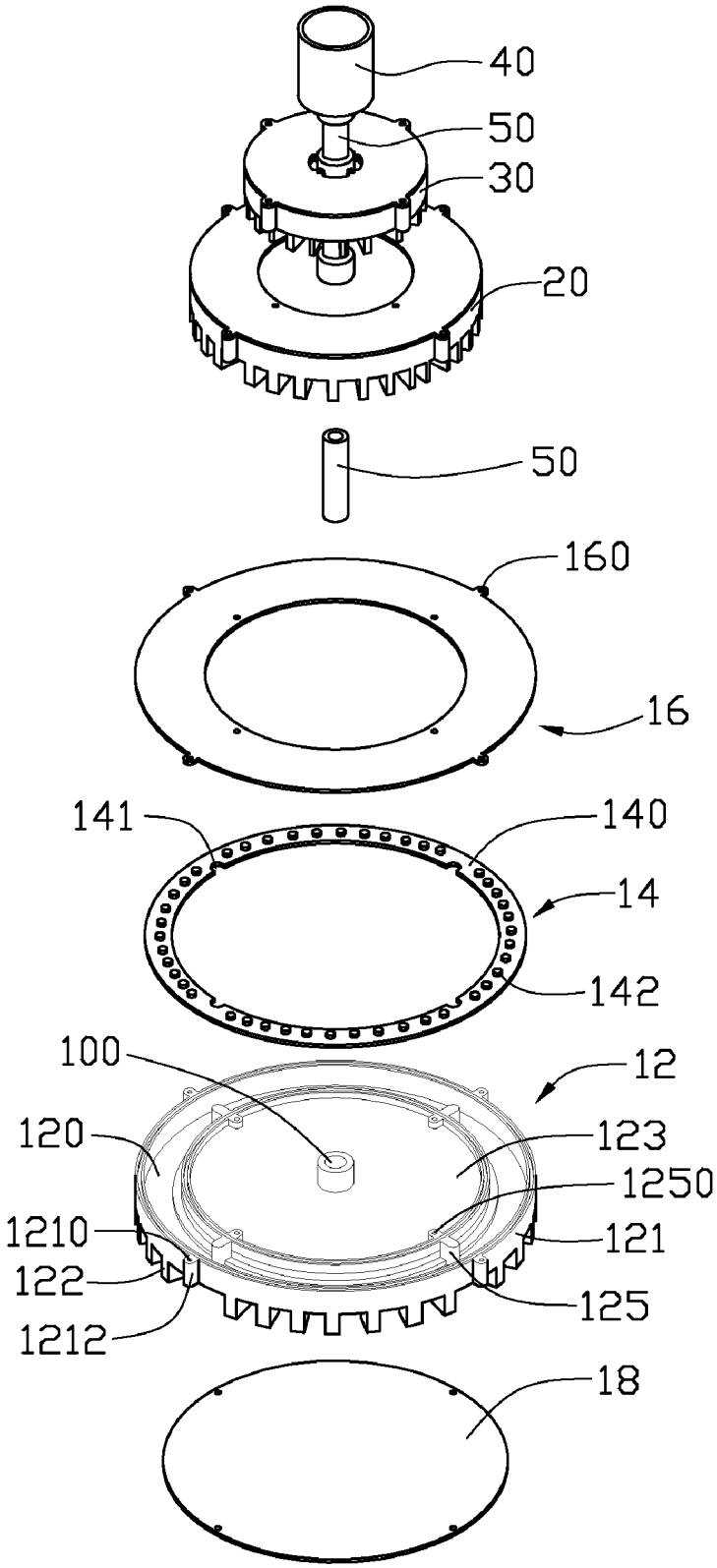
FIG. 3 is an inverted, exploded view of the LED lamp assembly of FIG. 1.

Also referring to FIG. 3, the first, second and third LED lamp modules 10, 20, 30 all have a similar configuration; only sizes of the first, second and third LED lamp modules 10, 20, 30 are different, in which the first LED lamp module 10 is larger than the second LED lamp module 20, which in turn is larger than the third LED lamp module 30. Taking the first LED lamp module 10 as an example, each of the first, second and third LED lamp modules 10, 20, 30 comprises a heat sink 12, an LED module 14 attached on a bottom face of the heat sink 12 and an envelope 16 fixed to the bottom face of the heat sink 12 and covering the LED module 14.

The heat sink 12 is a circular and made of a metal with a good heat conductivity such as copper or aluminum. The heat sink 12 comprises a periphery portion 121, a central portion 123 and four bridges 125 equidistantly and radially extending at a periphery of the central portion 123. An outer portion of each bridge 125 interconnects the central portion 123 and the periphery portion 121, and an inner portion of each bridge 125 define a threaded hole 1250 therein. The periphery portion 121 has a top face extending a plurality of fins 122 upwardly and perpendicularly, and a bottom face defining an annular concaved receiving portion 120 therein. In this embodiment, the receiving portion 120 is an annular trough between a periphery edge of the periphery portion 121 and the central portion 123. The four bridges 125 evenly distributed between the periphery portion 121 and the central portion 123. The bridges 125 have first ends thereof extending into the receiving portion 120 and second ends thereof extending to the central portion 123. A circular recession is defined at a center of a top face of the central portion 123 for receiving a driving circuit module therein. The fins 122 radially surround the recession. A round back plate 18 is disposed on the top face of the heat sink 12 and correspondingly covers the recession. A hollow column-shaped first fixing portion 100 extends downwardly and perpendicularly from a center of a bottom face of the central portion 123.

The LED module 14 comprises an annular printed circuit board 140 and a plurality of LEDs 142 arranged evenly thereon. The printed circuit board 140 defines four cutouts 141 in an inner edge thereof, which are equidistantly spaced from each other. The LED module 14 is directly received in the receiving portion 120 of the heat sink 12 with the cutouts 141 thereof fitly receiving the first ends of the bridges 125 of the heat sink 12.

The envelope 16 is annular and correspondingly disposed on the receiving portion 120 of the heat sink 12, with four ears evenly extending from an outer edge thereof and overlapping four ears evenly extending from an outer edge of the periphery portion 121 of the heat sink 12, thereby cooperating with the receiving portion 120 to enclose the LED module 14 between the envelope 16 and the heat sink 12. Screws (not shown) are used to extend through four holes (not labeled) defined in the envelope 16 near an inner hole (not labeled) thereof and screw into the threaded holes 1250. Furthermore, screws (not shown) are used to extend through the ears 160 and screw into threaded holes 1210 defined in protrusions 1212 of the periphery portion 121. Thus, the envelope 16 is secured to the heat sink 12.

Figure 4:
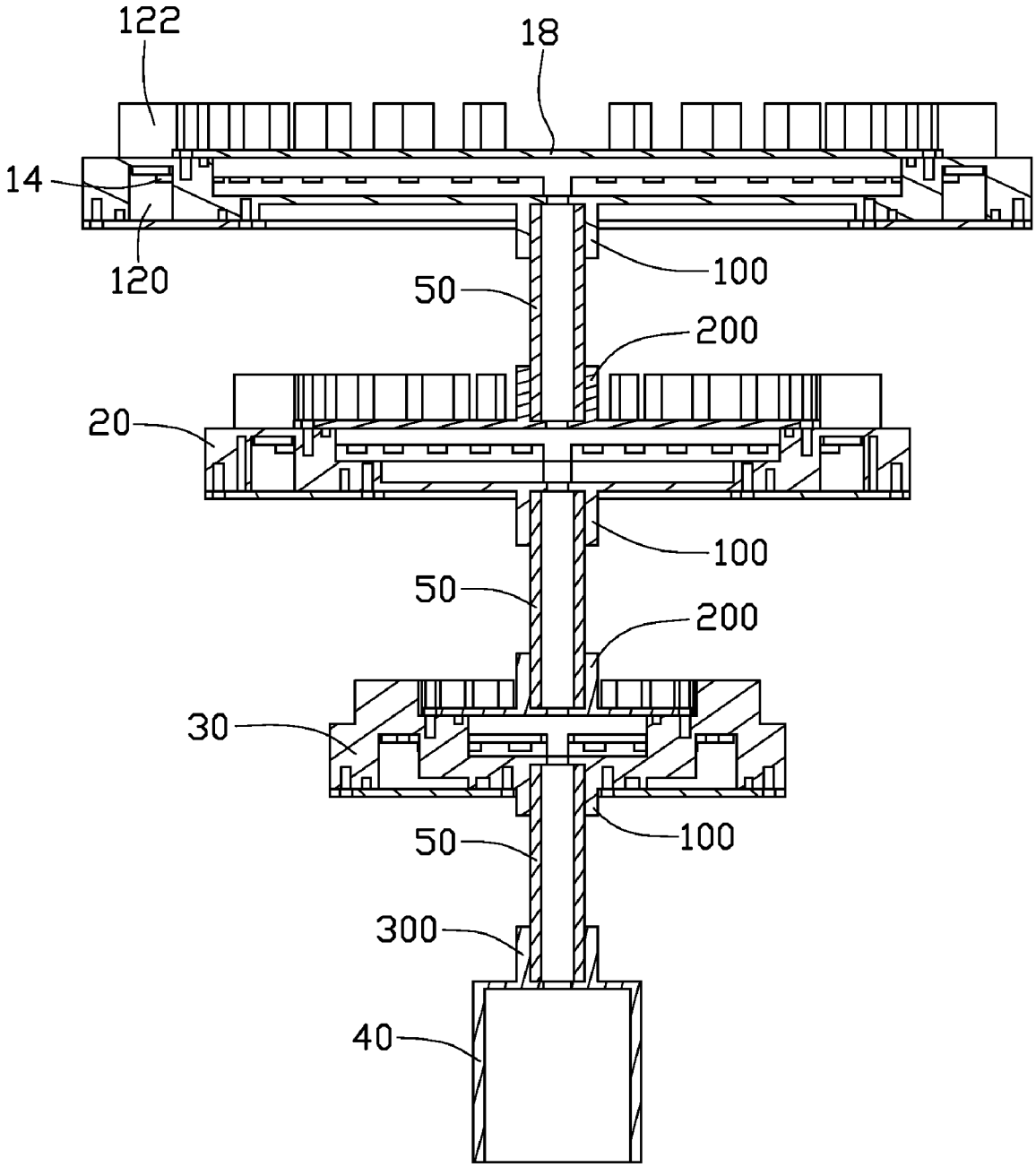
FIG. 4 is a cross-sectional view of the LED lamp assembly of FIG. 1, taken along a line IV-IV thereof.

Also referring to FIG. 4, the back plates 18 of the second and third LED lamp modules 20, 30 each further comprise a hollow, column-shaped second fixing portion 200 extending upwardly and perpendicularly from a center of a top face thereof. Diameters of the heat sinks 12 of the first, second and third LED lamp modules 10, 20, 30 gradually decrease from top to bottom. A diameter of the LED module 14 of the first LED lamp module 10 is larger than that of the heat sink 12 of the second LED lamp module 20, and a diameter of the LED module 14 of the second LED lamp module 20 is larger than that of the heat sink 12 of the third LED lamp module 30.

The fixing holder 40 is a hollow tube with an opening (not labeled) defined at a bottom thereof. The opening is used to engagingly receive a top end of a supporting rod (not shown) in order to secure the LED lamp assembly at a required position. A hollow column-shaped third fixing portion 300 extends upwardly and perpendicularly from a center of a top face of the fixing holder 40.

The fixing rods 50 each are an elongated column. A first of the fixing rods 50 stands vertically between and connects the first and second LED lamp modules 10, 20, wherein a top end of the first fixing rod 50 is engagingly received in the first fixing portion 100 of the first LED lamp module 10 and a bottom end of the first fixing rod 50 is engagingly received in the second fixing portion 200 of the second LED lamp module 20. A second of the fixing rods 50 stands vertically between and connects the second and third LED lamp modules 20, 30, wherein a top end of the second fixing rod 50 is engagingly received in the first fixing portion 100 of the second LED lamp module 20 and a bottom end of the second fixing rod 50 is engagingly received in the second fixing portion 200 of the third LED lamp module 30. A third of the fixing rods 50 stands vertically between and connects the third LED lamp module 30 and the fixing holder 40, wherein a top end of the third fixing rod 50 is engagingly received in the first fixing portion 100 of the third LED lamp module 30 and a bottom end of the third fixing rod 50 is engagingly received in the third fixing portion 300 of the fixing holder 40.

Referring to FIGS. 1-4 again, in assembly, the first, second and third LED lamp modules 10, 20, 30 are parallel to and spaced from each other. The fixing rods 50 are aligned with each other, whereby the first, second and third LED lamp modules 10, 20, 30 are coaxial and superposed. Diameters of the heat sinks 12 of the first, second and third LED lamp modules 10, 20, 30 gradually decrease from top to bottom, which makes the LED lamp assembly integrally having an inverted cone configuration.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp assembly comprising:

a fixing holder adapted for positioning the LED lamp assembly at a desired position; and a plurality of LED lamp modules superposed one by one on the fixing holder and spaced from each other, the LED lamp modules gradually decreasing in dimension along a superposing direction of the LED lamp modules;

wherein the fixing holder is located at a bottom end of the LED lamp assembly and opposite to a top end of the LED lamp assembly;

wherein each of the LED lamp modules comprises a heat sink and an LED module attached on the heat sink, the heat sink having a central portion and a periphery portion surrounding the central portion, and wherein the central portion and the periphery portion of the heat sink are connected by a plurality of spaced bridges.

2. The LED lamp assembly as claimed in claim 1, wherein the LED lamp modules are coaxial with and parallel to each other.

3. The LED lamp assembly as claimed in claim 1, wherein the LED lamp modules gradually decrease in dimension from the top end of the LED lamp assembly to the bottom end of the LED lamp assembly.

4. The LED lamp assembly as claimed in claim 1, wherein the LED lamp modules each comprise an envelope covering the LED module.

5. The LED lamp assembly as claimed in claim 4, wherein the LED module of an upper one of two adjacent LED lamp modules is greater in dimension than the heat sink of a lower one of the two adjacent LED lamp modules.

6. The LED lamp assembly as claimed in claim 4, wherein the LED module of each of the LED lamp modules is attached to a bottom face of a corresponding heat sink along a periphery thereof.

7. The LED lamp assembly as claimed in claim 6, wherein the bottom face of the heat sink of each of the LED lamp modules defines an annular receiving portion receiving a corresponding LED module therein.

8. The LED lamp assembly as claimed in claim 4, wherein the heat sink of each of the LED lamp modules is a circular plate, diameters of the heat sinks of the LED lamp modules gradually decrease along a direction for the top end to the bottom end of the LED lamp assembly.

9. The LED lamp assembly as claimed in claim 4, wherein a plurality of fins extend from a top face of the heat sink.

10. The LED lamp assembly as claimed in claim 1 further comprising a first fixing rod standing between and connecting two adjacent ones of the LED lamp modules.

11. The LED lamp assembly as claimed in claim 10 further comprising a second fixing rod standing between and connecting one of the two adjacent ones of the LED lamp modules and another LED lamp module, wherein the first and second fixing rods are aligned with each other and perpendicular to the LED lamp modules.

12. The LED lamp assembly as claimed in claim 10, wherein two opposite ends of the first fixing rod are engagingly received in the two adjacent ones of the LED lamp modules, respectively.

13. The LED lamp assembly as claimed in claim 1, wherein the bridges have first ends thereof extending outwardly toward the LED module.

14. The LED lamp assembly as claimed in claim 13, wherein the LED module comprises a circuit board and a plurality of LEDs mounted on the circuit board, the circuit board defining a plurality of spaced cutouts fittingly receiving the first ends of the bridges of the heat sink.

15. An LED lamp assembly comprising:

a plurality of superposed LED lamp modules, each of the LED lamp modules comprising a heat sink and an LED module attached to the heat sink, the heat sinks of the LED lamp modules gradually increasing in dimension along a superposing direction of the LED lamp modules, the LED lamp modules being connected by at least a rod between the heat sinks;

wherein the heat sink of each of the LED lamp modules comprises a central portion and a periphery portion surrounding the central portion;

wherein the LED module is attached to the periphery portion of the heat sink; and wherein the central portion and the periphery portion of the heat sink are connected by a plurality of spaced bridges, the bridges having first ends thereof extending outwardly toward the LED module.

16. The LED lamp assembly as claimed in claim 15, wherein the at least a rod connects the central portions of the heat sinks of the LED lamp modules.

17. The LED lamp assembly as claimed in claim 15, wherein the LED module comprises a circuit board and a plurality of LEDs mounted on the circuit board, the circuit board defining a plurality of spaced cutouts fittingly receiving the first ends of the bridges of the heat sink.

18. The LED lamp assembly as claimed in claim 15, wherein each of the LED lamp modules comprises an envelope covering the LED module thereof.

* * * * *